US011274503B2

(12) United States Patent
Dokhon et al.

(10) Patent No.: US 11,274,503 B2
(45) Date of Patent: Mar. 15, 2022

(54) CAPILLARY TUBING FOR DOWNHOLE FLUID LOSS REPAIR

(71) Applicant: Saudi Arabian Oil Company, Dhahran (SA)

(72) Inventors: Waleed A. Dokhon, Al Khobar (SA); Fahmi Aulia, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/544,302

(22) Filed: Aug. 19, 2019

(65) Prior Publication Data

US 2021/0054697 A1 Feb. 25, 2021

(51) Int. Cl.
*E21B 33/138* (2006.01)
*E21B 17/18* (2006.01)
*E21B 34/06* (2006.01)

(52) U.S. Cl.
CPC ..... *E21B 17/18* (2013.01); *E21B 33/138* (2013.01); *E21B 34/06* (2013.01)

(58) Field of Classification Search
CPC ..... E21B 17/18; E21B 33/138
USPC ..... 166/289
See application file for complete search history.

(56) References Cited

U.S. PATENT DOCUMENTS 6,557,629 B2 * 5/2003 Wong ..... E21B 33/068 166/76.1
8,066,063 B2 * 11/2011 Donald ..... E21B 37/06 166/88.4
9,376,896 B2 * 6/2016 Smith ..... E21B 43/16
2004/0206507 A1 * 10/2004 Bunney ..... E21B 33/068 166/312
2009/0277643 A1 * 11/2009 Mondelli ..... E21B 34/107 166/319

FOREIGN PATENT DOCUMENTS

| | | |
|---|---|---|
| EP | 0988439 | 3/2000 |
| GB | 2433115 | 6/2007 |
| WO | WO 2016128752 | 8/2016 |
| WO | WO2017196955 | 11/2017 |

OTHER PUBLICATIONS

PCT International Search Report and Written Opinion in International Application No. PCT/US2020/046,757, dated Nov. 2, 2020, 13 pages.

* cited by examiner

*Primary Examiner* — Zakiya W Bates
*Assistant Examiner* — Ashish K Varma
(74) *Attorney, Agent, or Firm* — Fish & Richardson P.C.

(57) ABSTRACT

A well tubing system includes a well tubing extending from a wellhead and disposed in a wellbore, and multiple capillary tubes coupled to the wellhead and extending from the wellhead into an annulus formed between an outer surface of the well tubing and a wall of the wellbore. The multiple capillary tubes provide a sealing fluid to the annulus, and extend to a respective multiple depths in the wellbore, where the multiple depths are different from each other. The capillary tubes guide the sealing fluid from the wellhead into the annulus, and provide the sealing fluid to the annulus.

21 Claims, 6 Drawing Sheets

CAPILLARY TUBING FOR DOWNHOLE FLUID LOSS REPAIR

TECHNICAL FIELD

This disclosure relates to well tubing, and more particularly to capillary tubing in wellbores.

BACKGROUND

Production operations of a hydrocarbon well require control of a downhole wellbore environment. Fluid leaks in downhole wellbore environments can cause operational problems or delays to a producing well, which can be expensive to address. Well treatment systems that address fluid leaks often require well intervention and workover, or valve tools formed in a well string.

SUMMARY

This disclosure describes well tubing systems including capillary tubes to provide fluid to a wellbore annulus.

In some aspects, a well tubing system includes a well tubing extending from a wellhead and disposed in a wellbore, and multiple capillary tubes coupled to the wellhead and extending from the wellhead into an annulus formed between an outer surface of the well tubing and a wall of the wellbore. The multiple capillary tubes are to provide a sealing fluid to the annulus, where the multiple capillary tubes extend to a respective number of depths in the wellbore, the respective number of depths being different from each other.

This, and other aspects, can include one or more of the following features. The multiple capillary tubes can extend longitudinally along the outer surface of the well tubing in contact with the outer surface of the well tubing. At least a portion of each of the multiple capillary tubes can be at least partially coiled around the outer surface of the well tubing. At least the portion of each of the multiple capillary tubes can be at least partially coiled around the outer surface of the well tubing at an uphole location proximate to the wellhead. The multiple capillary tubes can be dispersed radially about the well tubing. The longitudinal lengths of the multiple capillary tubes can be distributed evenly between a minimum threshold length and a maximum threshold length. The multiple capillary tubes can include a first capillary tube extending a first longitudinal length along the well tubing, a second capillary tube extending a second longitudinal length along the well tubing greater than the first longitudinal length, and a third capillary tube extending a third longitudinal length along the well tubing greater than the second longitudinal length. The first longitudinal length of the first tubing, the second longitudinal length of the second tubing, and the third longitudinal length of the third tubing can be evenly distributed between an uphole longitudinal end of the well tubing and a downhole longitudinal end of the well tubing. The third longitudinal length can include an entire longitudinal length of the well tubing, the second longitudinal length can include about two-thirds of the entire longitudinal length of the well tubing, and the first longitudinal length can include about one-third of the entire longitudinal length of the well tubing. Each capillary tube in the multiple capillary tubes can include a fluid valve at a downhole longitudinal end of the respective capillary tube, the fluid valve to selectively control fluid flow through the respective capillary tube. The fluid valve can include a one-way check valve to selectively flow fluid from within the respective capillary valve into the annulus. The well tubing system can include a clamp to attach at least one of the capillary tubes of the multiple capillary tubes to the outer surface of the well tubing. The well tubing system can include multiple clamps positioned longitudinally along the well tubing to attach at least one capillary tube of the multiple capillary tubes to the outer surface of the well tubing. The wellbore can be a cased wellbore, the wall of the wellbore can include a casing, and the annulus can be a tubing-casing annulus. The well tubing can include a production tubing.

Certain aspects encompass a method for providing a sealing fluid to an annulus of a wellbore. The method includes guiding a sealing fluid through at least one capillary tube of multiple capillary tubes coupled to a wellhead and extending from the wellhead into an annulus formed between an outer surface of a well tubing and a wall of the wellbore. The well tubing extends from the wellhead and is disposed in the wellbore. The method also includes providing the sealing fluid to the annulus through at least one capillary tube of the multiple capillary tubes, where the multiple capillary tubes extend to a respective number of depths in the wellbore, the respective number of depths being different from each other.

This, and other aspects, can include one or more of the following features. At least a portion of each of the multiple capillary tubes can be at least partially coiled around the outer surface of the well tubing, and the method can further include partially uncoiling or partially recoiling the plurality of capillary tubes in response to an expansion or retraction of the well tubing. The method can include attaching, with at least one clamping structure, the multiple capillary tubes to the well tubing. The multiple capillary tubes can include a first capillary tube, a second capillary tube, and a third capillary tube, where the first capillary tube extends a first longitudinal length along the well tubing, the second capillary tube extends a second longitudinal length along the well tubing greater than the first longitudinal length, and the third capillary tube extends a third longitudinal length along the well tubing greater than the second longitudinal length. Providing the sealing fluid to the annulus can include providing the sealing fluid to the annulus at a first wellbore depth through the first capillary tube, providing the sealing fluid to the annulus at a second wellbore depth through the second capillary tube, or providing the sealing fluid to the annulus at a third wellbore depth through the third capillary tube. Each capillary tube of the multiple capillary tubes can include a fluid valve at a downhole longitudinal end of the respective capillary tube, and providing the sealing fluid to the annulus can include selectively controlling flow of the sealing fluid through the respective fluid valve at the downhole longitudinal end of the respective capillary tube. Each fluid valve can include a one-way check valve, and selectively controlling flow of the sealing fluid though the respective fluid valve can include selectively flowing the sealing fluid from within the respective capillary valve into the annulus.

In some aspects, a well tubing system includes a production tubing extending from a wellhead and to be disposed in a wellbore, and multiple capillary tubes coupled to the wellhead and extending from the wellhead into an annulus formed radially outward of the production tubing. The multiple capillary tubes extend longitudinally at least partially along an outer surface of the production tubing, and provide a sealing fluid to the annulus.

This, and other aspects, can include one or more of the following features. The multiple capillary tubes can include a first capillary tube extending a first longitudinal length along the production tubing, a second capillary tube extending a second longitudinal length along the production tubing greater than the first longitudinal length, and a third capillary tube extending a third longitudinal length along the production tubing greater than the second longitudinal length.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
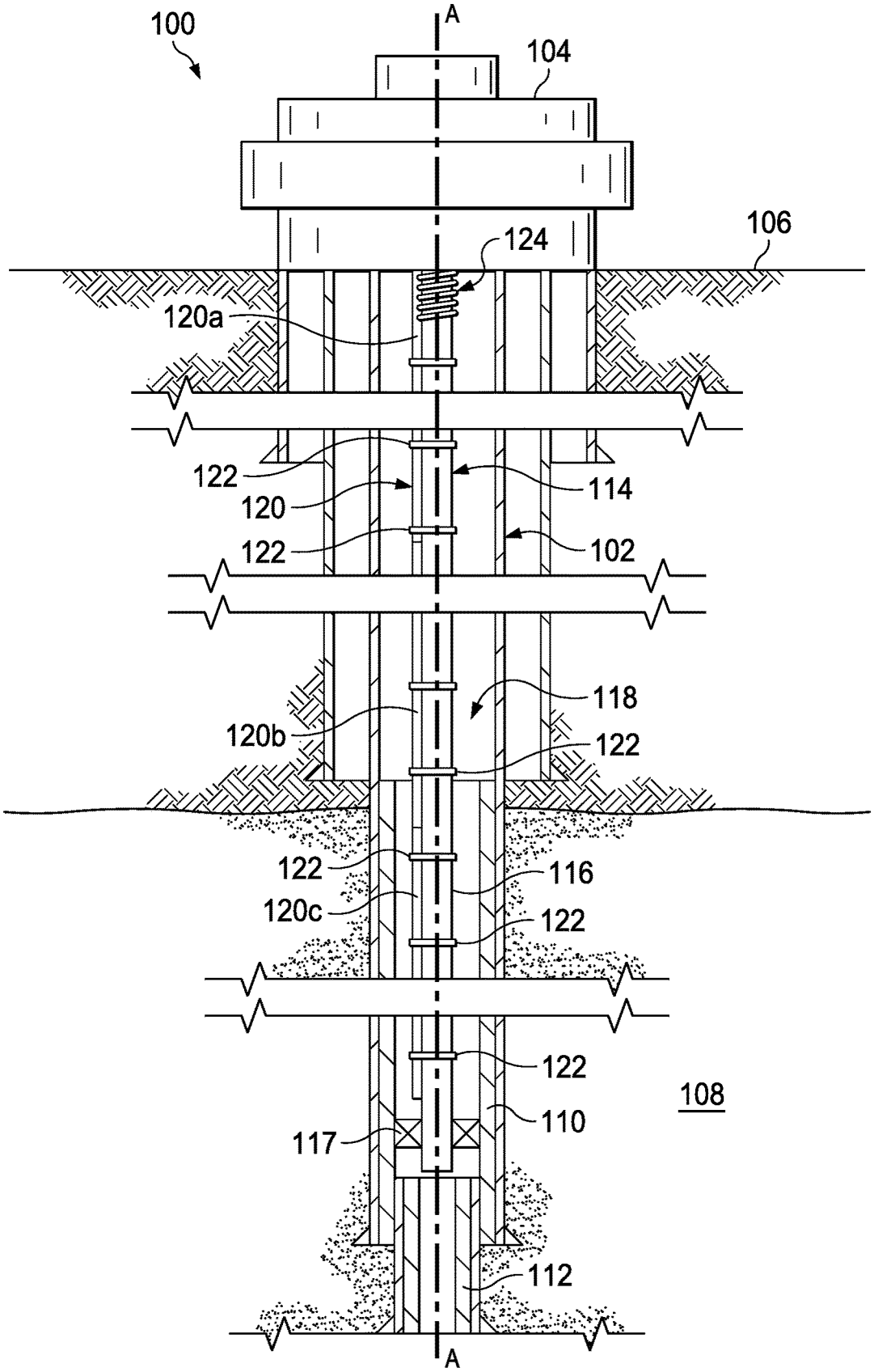
FIG. 1 is a schematic partial cross-sectional side view of an example well system including a tubing string with multiple capillary tubes.

This disclosure describes multiple capillary tubes arranged along a tubing string to provide fluid, such as sealing fluid, to a wellbore at a desired depth along the tubing string disposed in the wellbore. In some instances, a tubing string extends from a wellhead and is disposed in a wellbore, and the tubing string includes multiple capillary tubes extending from the wellhead and longitudinally along an exterior of the tubing string. The capillary tubes can direct and provide a fluid, such as a sealant or chemical fluid, from the wellhead to the annulus formed between the tubing string and a wall of the wellbore. For example, in response to a fluid leak or other unwanted fluid flow in a wellbore, one or more of the capillary tubes provide fluid to the annulus that can seal the unwanted fluid flow or other fluid communication in the annulus, such as a leak in a production packer or in a wellbore wall. The capillary tubes are disposed radially about the tubing string, and extend along a length of the tubing string to various longitudinal depths in the annulus. In some examples, the multiple capillary tubes include a first capillary tube that extends substantially the entire longitudinal length of the annulus or of tubing string, a second capillary tube that extends a percentage of the length of the first capillary tube (for example, 66%, or ⅔), and a third capillary tube that extends a second percentage of the length of the first capillary tube (for example, 33%, or ⅓). The number of capillary tubes and respective lengths of the capillary tubes can vary, and are distributed to be able to provide fluid (for example, sealant or other chemical fluid) to a location proximate to an unwanted fluid flow in the annulus. For example, for a tubing string with multiple capillary tubes distributed along a length of an annulus, the capillary tube with a respective downhole longitudinal end that is closest to the location of an unwanted fluid flow or leak can be utilized to provide sealant or other fluid to the unwanted fluid flow or leak to seal (or otherwise address) the fluid flow or leak.

Each of the capillary tubes can include a coiled portion at an uphole end of each respective capillary tube, where a portion of the respective capillary tube is wrapped around the tubing string, for example, to accommodate for expansion and compression of the tubing string during operation, installation, or both. In some instances, the tubing string can be a production tubing, though the tubing string can include other types of well strings, such as a testing string or other well string. The tubing string can be disposed in an open hole portion, a cased hole portion, or another portion of a wellbore. For example, the wellbore wall described earlier can include an open-hole wall portion of a wellbore, a casing portion of a cased wellbore, or other wall portion of a wellbore, such as in wells that have a tubing-casing-annulus equipped with a production packer. The annulus that the capillary tubes are disposed in can be a tubing-casing annulus between the production tubing (or other well tubing type) and a casing wall of the wellbore.

In some conventional well systems, unwanted fluid flow and fluid leaks in a wellbore require well intervention and workover to seal or otherwise address the unwanted fluid flow. Well interventions can be risky, and workovers can be costly. In some implementations of the present disclosure, capillary tubes connected at a wellhead and extending along a tubing string to various depths can provide sealant or other fluid to one or more desired depths in a wellbore. The capillary tubes can be disposed in the wellbore annulus during normal operation of a tubing string, and can address unwanted fluid flow without requiring well interventions, workovers, or other adjusted use of production tubing or other well tubing disposed in the wellbore. Since fluid flow through the capillary tubes can be controlled separately from a production tubing or other well tubing disposed in a wellbore (for example, via the wellhead), downhole fluid leaks can be addressed by the capillary tubes without downtime of or considerable work from other downhole components. Incorporating capillary tubes in a tubing string, as described in this disclosure, can increase a lifespan of a well and achieve cost savings, for example, by eliminating or reducing risky well interventions or workovers to address fluid leaks or other unwanted fluid flow in a wellbore. Moreover, in some examples, capillary tubes can also be used as media to fill up an annulus (for example, the tubing-casing-annulus) with diesel including corrosion inhibitor as part of corrosion protection to prolong the life of and integrity of a well.

FIG. 1 is a schematic partial cross-sectional side view of an example well system 100 that includes a substantially cylindrical wellbore 102 extending from a wellhead 104 at a surface 106 downward into the Earth into one or more subterranean zones of interest. In the example well system 100 of FIG. 1, one subterranean zone of interest 108 is shown. The well system 100 includes a vertical well, with the wellbore 102 extending substantially vertically from the surface 106 to the subterranean zone of interest 108. The concepts described here, however, are applicable to many different configurations of wells, including vertical, horizontal, slanted, or otherwise deviated wells.

After some or all of the wellbore 102 is drilled, a portion of the wellbore 102 extending from the wellhead 104 to the subterranean zone 108 can be lined with lengths of tubing, called casing or liner. The wellbore 102 can be drilled in stages, and a casing may be installed between stages. In the example well system 100 of FIG. 1, the wellbore 102 is shown as having been drilled in multiple stages (for example, four stages), with a first casing 110 at one of the stages and a second casing 112 at another of the stages. The first casing 110 can be defined by lengths of tubing lining a first portion of the wellbore 102, and the second casing 112 can be defined by lengths of tubing lining a second portion of the wellbore 102. The first casing 110 is shown as extending only partially down the wellbore 102 and into the subterranean zone 108; however, the first casing 110 can extend further into the wellbore 102 or end further uphole in the wellbore 102 than what is shown schematically in FIG. 1. The second casing 112 is shown as extending only partially along the wellbore 102 downhole of the first casing 110; however, the second casing 112 can extend further into the wellbore 102 or end further uphole in the wellbore 102 than what is shown schematically in FIG. 1. While FIG. 1 shows the example well system 100 as including two casings (first casing 110 and second casing 112), the well system 100 can include more casings or fewer casings, such as one, three, four, or more casings. In some examples, the well system 100 excludes casings, and the wellbore 102 is at least partially or entirely open bore.

The wellhead 104 defines an attachment point for other equipment of the well system 100 to attach to the well 102. For example, the wellhead 104 can include a Christmas tree structure including valves used to regulate flow into or out of the wellbore 102. In the example well system 100 of FIG. 1, a tubing string 114 is shown as having been lowered from the wellhead 104 at the surface 106 into the wellbore 102. In some instances, the tubing string 114 includes a series of jointed lengths of tubing coupled end-to-end or a continuous (or, not jointed) coiled tubing. The tubing string includes a central well tubing 116. The tubing string 114 is shown in FIG. 1 as a production string, where the well tubing 116 is a production tubing, but the tubing string 114 can alternatively make up a work string, testing string, or other well string with a well tubing used during the lifetime of the well system 100. The tubing string 114 can include a number of different well tools that can test, produce, intervene, or otherwise engage the wellbore 102. For example, in the example well system 100 of FIG. 1, the tubing string 114 includes a packer element 117 on the well tubing 116 and proximate to a downhole longitudinal end of the tubing string 114, where the packer element 117 can seal to an inner wall of the wellbore 102. In certain implementations, the tubing string 114 excludes the packer element 117, or includes one or more well tools in addition to or instead of the packer element 117.

The surface that defines the inner wall of the wellbore 102 can vary, for example, based on the type of well, the depth of the wellbore 102, a combination of these, or other factors. In some instances, the inner wall of the wellbore 102 includes the inner wall of the first casing 110, though the inner wall of the wellbore 102 can be different. For example, the inner wall of the wellbore 102 can include an inner wall of the first casing 110, an inner wall of the second casing 112, an inner wall of an open bore portion of the wellbore 102, or a different surface wall of the wellbore 102. The tubing string 114 can include additional or alternative components to the packer element 117, for example, based on a desired operation of the tubing string 114.

The tubing string 114 is positioned in the wellbore 102, and the annular space between the outer surface of the well tubing 116 of the tubing string 114 and the wall of the wellbore 102 forms an annulus 118. In some instances, the annulus 118 is a tubing-casing-annulus (TCA), defined by the annular space between a tubing disposed in the wellbore 102 and a casing wall of the wellbore 102. In certain implementations, the wellhead 104 includes a TCA valve positioned at an uphole longitudinal end of the TCA. The TCA valve can control pressure, fluid flow, or other characteristics of fluid in the TCA proximate the wellhead 104. The TCA valve can also provide control of fluid through capillary tubes attached to the wellhead at the TCA valve, as described in greater detail later.

The tubing string 114 includes multiple capillary tubes 120 coupled to the wellhead 104 (for example, at the TCA valve) and extending from the wellhead 104 into the annulus 118 formed between an outer surface of the well tubing 116 and a wall of the wellbore 102. The capillary tubes 120 are elongate cylindrical lengths of tubing with an outer diameter and an inner diameter that defines an inner channel configured to allow the passage of fluid through the respective capillary tube. Each capillary tube of the multiple capillary tubes 120 can be the same size or can vary in size, for example, based on length of the capillary tube or intended depth that the capillary tube is to extend into the wellbore 102. In some examples, capillary tubes intended to extend deeper into the wellbore can include a larger outer diameter. The capillary tubes 120 can be seamless lengths of tubing, which can be flexible, rigid, or both (for example, portions of flexible tubing and portions of rigid tubing), and can vary in materials. For example, the capillary tubes 120 can be formed from a flexible or rigid plastic or metal, such as 316 stainless steel, A825 alloy, duplex 2205/2507, alloy 625, or other materials.

The capillary tubes 120 extending from the wellhead 104 are disposed entirely within the annulus 118. As such, the capillary tubes 120 are rugged enough to withstand the harsh environment of the wellbore 102, for example, due to the presence of caustic fluids, pressure extremes, and temperature extremes in the downhole environment. The capillary tubes 120 are attached at the wellhead 104 and extend along the well tube 116 of the tubing string 114, but can function separately from operations of the well tubing 116, such as production operations or other downhole operations. For example, the capillary tubes 120 provide the ability to provide fluid, such as sealant or chemical fluid, to the annulus at a plurality of downhole depths of the wellbore 102, to measure a pressure in the annulus at the plurality of downhole depths of the wellbore 102, to provide other control operations at the plurality of downhole depths, or a combination of these functions. The capillary tubes 120 can provide one or more of these functions without disrupting operations of the well tubing 116 or other operations of the tubing string 114 or wellhead 104.

In the example well system 100 of FIG. 1, the multiple capillary tubes 120 include a first capillary tube 120*a*, a second capillary tube 120*b*, and a third capillary tube 120*c*, described in more detail later. In some instances, the multiple capillary tubes 120 include more than three, exactly three, or less than three capillary tubes. The multiple capillary tubes 120 extend to a respective plurality of depths in the annulus 118 of the wellbore 102, with the respective plurality of depths being different from each other. The capillary tubes 120 provide a fluid, such as a sealant, chemical fluid, or other fluid, to the annulus 118, for example, to seal or otherwise address an unwanted fluid flow or fluid leak in a wellbore wall, tubing, or other downhole surface. In some examples, the chemical fluid can include a corrosion inhibitor, a scavenger (such as H2S scavenger), or other chemical fluids to treat a downhole component.

The unwanted fluid flow or fluid leak in the wellbore 102 can take a variety of forms. For example, the unwanted fluid flow or fluid leak can include a leak in a production packer (for example, packer element 117), in the first casing 110, in the second casing 112, in an open-bore portion of the wellbore 102, in the well tubing 116 or other component of the tubing string 114, a combination of these, or in another downhole component of the well system 100. In some instances, sealant is provided at the wellhead 104 to one or more of the capillary tubes 120, and the one or more capillary tubes 120 directs and provides the sealant to the annulus 118 at a location proximate to the unwanted fluid flow or fluid leak. The particular one or more capillary tubes can be chosen based on the relative proximity of its downhole longitudinal end to the location of the fluid leak. For example, the capillary tube with a respective downhole longitudinal end that is closest to the leak can provide sealant (or other fluid) to the annulus 118, and the sealant is configured to flow to and seal the leak.

The multiple capillary tubes 120 extend longitudinally along the outer surface of the well tubing 116 of the tubing string 114, for example, in contact with the outer surface of the well tubing 116. The longitudinal lengths of the capillary tubes 120 can be distributed evenly or unevenly along the longitudinal length of the tubing string 114, of the annulus 118, or both. In some implementations, the longitudinal lengths of the capillary tubes 120 are distributed evenly between a minimum threshold length and a maximum threshold length, such as between an uphole longitudinal end of the tubing string 114 and a downhole longitudinal end of the tubing string 114. In some instances, the minimum threshold length can correspond to the uphole longitudinal end of the tubing string 114, or a minimum wellbore depth, such as zero, forty feet, or another depth, and the maximum threshold length can correspond to an entire depth of the annulus 118, an entire length of the tubing string 114, the depth of available space of annulus 118 (for example, down to the packer element 117 or other tool in the annulus 118), or another length along the wellbore 102.

The example well system 100 of FIG. 1 shows three capillary tubes 120: first capillary tube 120*a*, second capillary tube 120*b*, and third capillary tube 120*c*. The number of capillary tubes can vary, though. For example, it follows that the more capillary tubes there are, the more opportunities there are to direct fluid closer to a fluid leak. However, in certain wellbores, the annular space between a tubing string and a casing wall (or other wellbore wall) can be limited, and can present maintenance challenges if the annular space is crowded with capillary tubes. The optimal number of capillary tubes can be decided based on a number of variables, such as tubing string size, casing size or other wellbore wall size, well stability, a combination of these, or other factors. In some implementations, an outer diameter of the capillary tubes is sized to be less than half of the radial dimension of the annulus, for example, to provide sufficient space for the capillary tubes 120 to coil proximate an uphole end of the tubing string 114. This coiled portion is described in more detail layer. In some examples, the outer diameter of the capillary tubes are no more than 0.75 inches for an annulus defined by a 7 inch casing (inner diameter of about 6.184 inches) and a 4.5 inch outer diameter well tubing. For example, the capillary tubes can include an outer diameter of 0.625 inches or less.

In the example well system 100 of FIG. 1, the first capillary tube 120*a*, second capillary tube 120*b*, and third capillary tube 120*c* are distributed (about or exactly) evenly along the entire length of the well tubing 116 of the tubing string 114, for example, between an uphole longitudinal end of the tubing string 114 and a downhole longitudinal end of the tubing string 114. In the example well system 100 of FIG. 1, the downhole longitudinal end of the tubing string 114 is generally where the packer element 117 is positioned on the tubing string 114. The first capillary tube 120*a* extends a first longitudinal length along the well tubing 116 equal to about one-third of the entire longitudinal length of the well tubing 116. The second capillary tube 120*b* extends a second longitudinal length about two-thirds of the entire longitudinal length of the well tubing 116. The third capillary tube 120*c* extends a third longitudinal length that is about the entire length (or just less than the entire length) of the well tubing 116. For example, the third capillary tube 120*c* can extend to the packer element 117, or just above the packer element 117 (such as about 100 feet uphole of the packer element 117). Of course, the first, second, and third longitudinal lengths can vary, for example, based on the number of capillary tubes, length of the tubing string 114, desired distribution of capillary tubes, other well tools present in the annulus 118, or other factors. The longitudinal lengths of the multiple capillary tubes 120 are different from each other to correspond to different depths in the annulus 118 of the wellbore 102. In some examples, the second longitudinal length is greater than the first longitudinal length, and the third longitudinal length is greater than the second longitudinal length.

Figure 2:
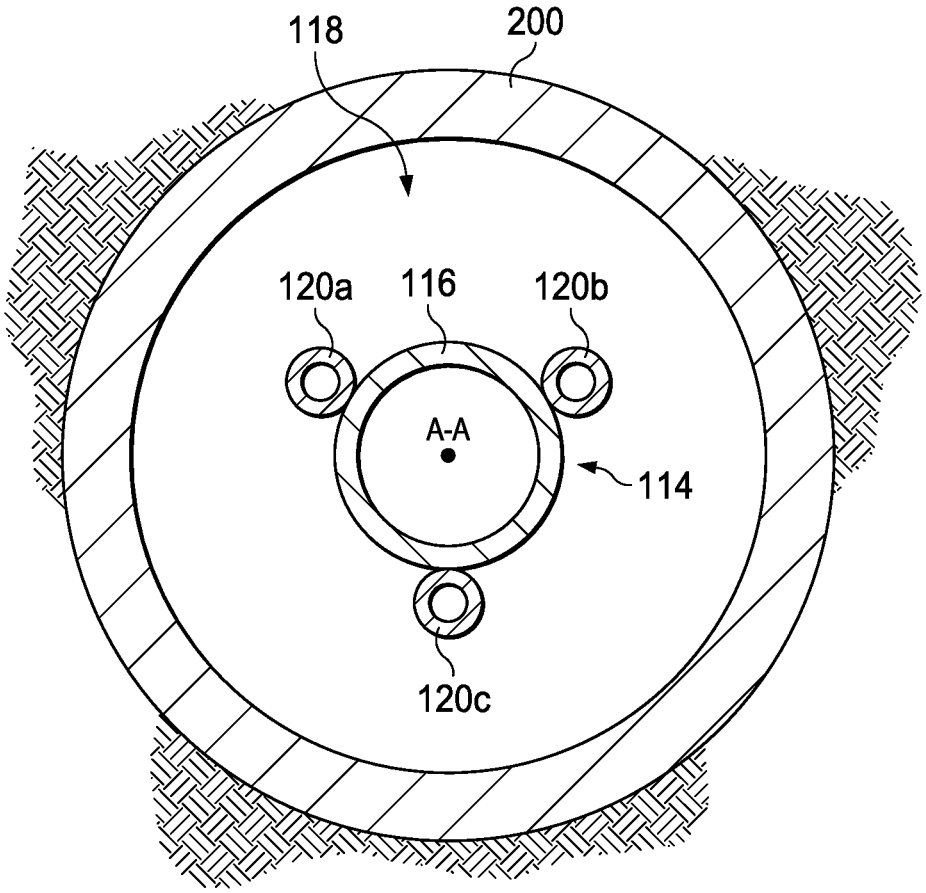
FIG. 2 is a partial cross-sectional top view of an example tubing string disposed in a wellbore, with capillary tubes radially distributed about the tubing string.

The schematic side view of the well system of FIG. 1 shows the three capillary tubes 120*a*, 120*b*, and 120*c* as substantially adjacent each other along one side of the tubing string 114. However, the distribution of the capillary tubes about the tubing string 114 can vary. FIG. 2 is a partial cross-sectional top view of the tubing string 114 disposed in the wellbore 102 of FIG. 1, with the capillary tubes 120*a*, 120*b*, and 120*c* radially distributed about the tubing string 114. FIG. 2 shows the central well tubing 116 of the tubing string 114, the first capillary tube 120*a*, the second capillary tube 120*b*, and the third capillary tube 120*c* disposed radially about the well tubing 116, the annulus 118 of the wellbore 102, and the wellbore wall 200 defining an inner surface of the wellbore 102. The first capillary tube 120*a*, the second capillary tube 120*b*, and the third capillary tube 120*c* are shown as dispersed evenly about the circumference of the well tubing 116 of the tubing string 114; however, in some instances, the capillary tubes can be dispersed evenly or unevenly about the well tubing 116. Though the example tubing string 114 of FIG. 2 shows three capillary tubes, the example tubing string 114 can include more or fewer capillary tubes about the well tubing 116.

Figure 3:
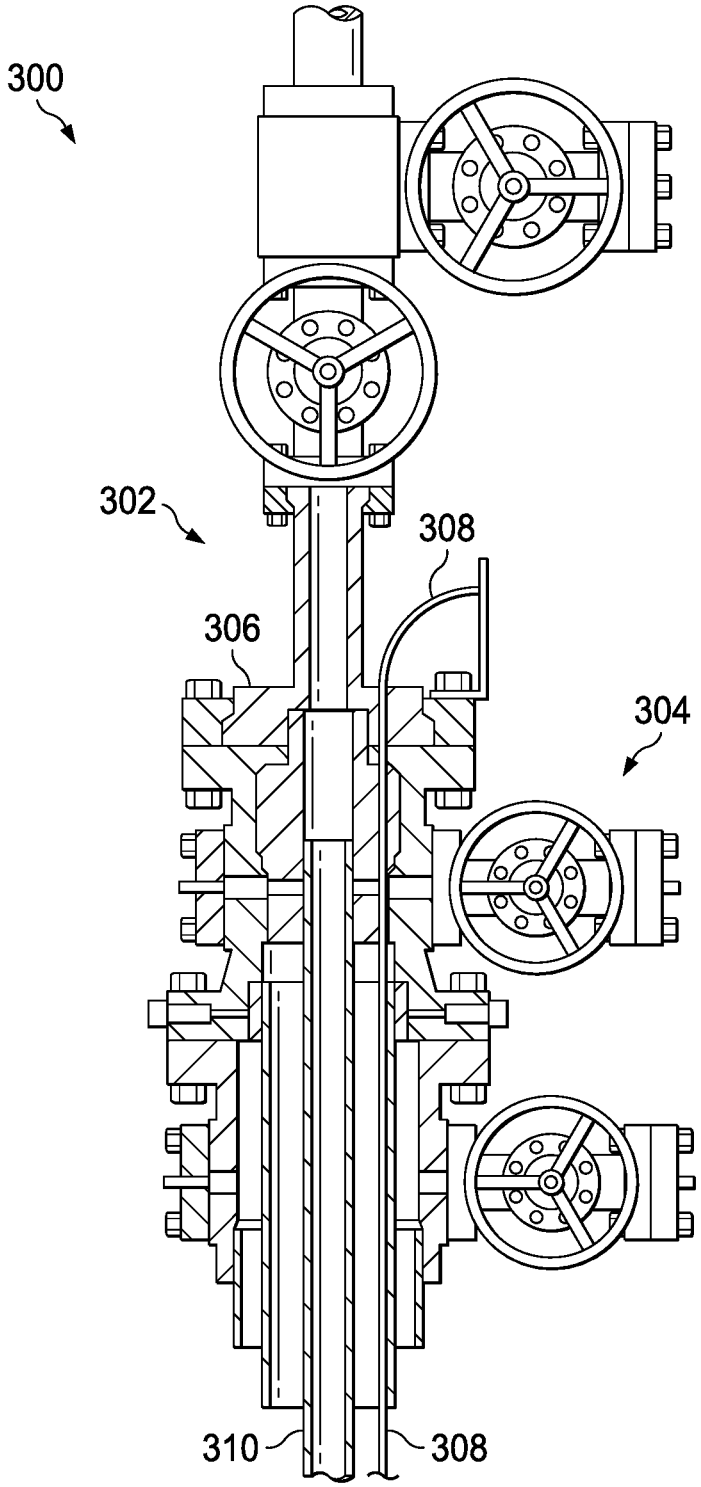
FIG. 3 is a partial cross-sectional side view of an example wellhead system including a wellhead with a tubing-casing-annulus valve coupled to capillary tubes
Figure 4:
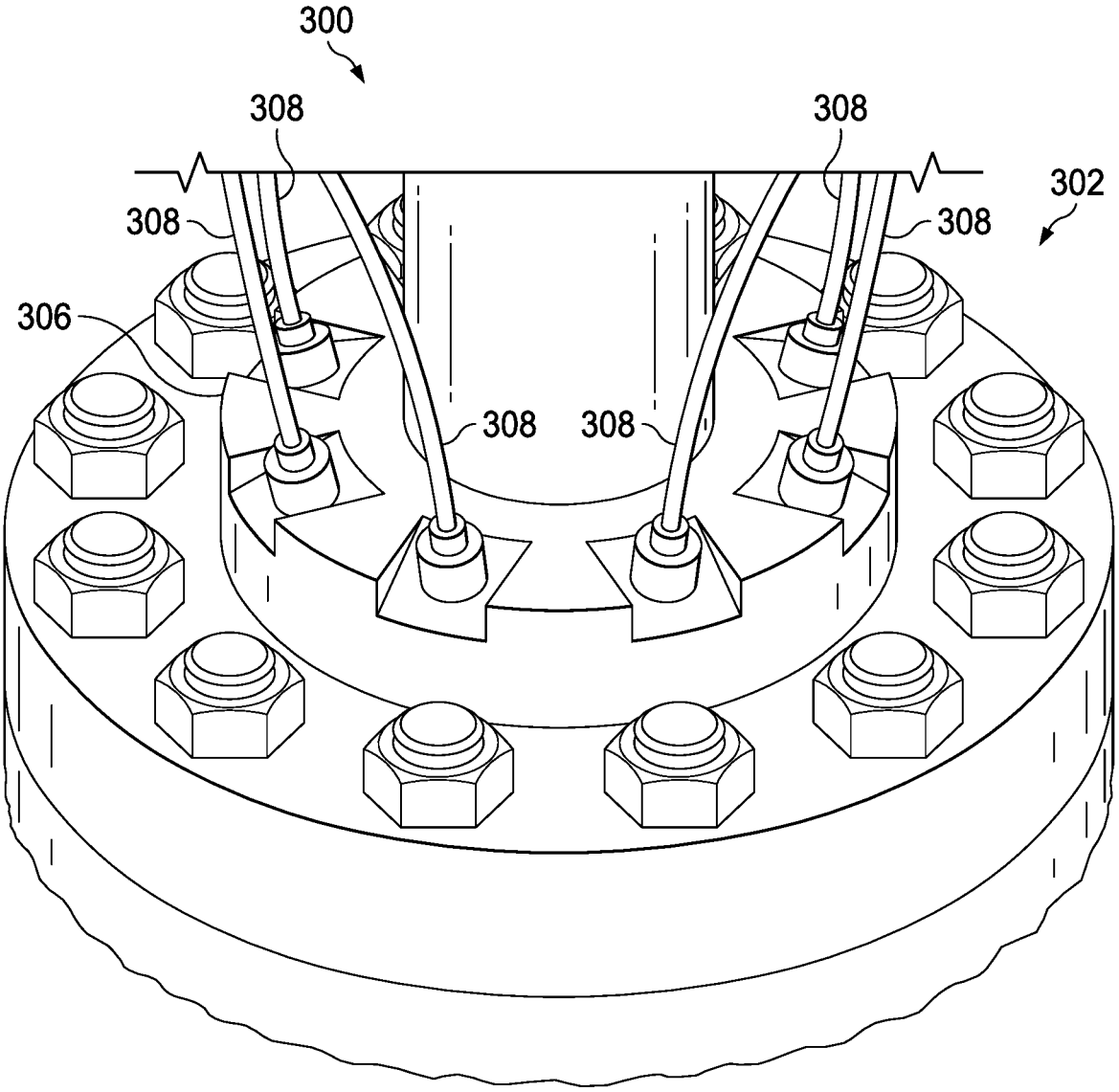
FIG. 4 is a partial schematic front perspective view of the example wellhead system of FIG. 3.

Referring to both FIGS. 1 and 2, the capillary tubes 120 can provide fluid to the annulus 118 at a specified depth of the wellbore 102 corresponding to the downhole longitudinal end of the respective capillary tube 120, for example, in response to a downhole fluid leak. Flow of the fluid through the capillary tubes 120 can be controlled at the wellhead 104, at the respective capillary tubes 120 themselves, or both. For example, the capillary tubes 120 connect to and engage with the wellhead 104, and can include respective control valves to receive, control, and provide fluid through the respective capillary tube of the multiple capillary tubes 120. For example, FIG. 3 is a partial cross-sectional side view of an example wellhead system 300 including a wellhead 302 with a TCA valve 304 having a top flange 306, capillary tubes 308 (one shown) coupled to and extending through the top flange 306, and a tubing string 310 extending from the wellhead 302. The example wellhead system 300, such as the wellhead 302, capillary tubes 308, and tubing string 310, can be implemented in the example well system 100 of FIG. 1. Further, FIG. 4 is a partial schematic front perspective view of the example wellhead system 300 of FIG. 3, showing exit points of the capillary tubes 308 (six shown) on a top side of the top flange 306 of the TCA valve 304. The top flange 306 includes channels through which the capillary tubes 308 pass through. At the wellhead 302 or elsewhere uphole of the top flange 306, the capillary tubes 308 can be controlled to pump fluid, such as sealant, chemical fluid, or other fluid, through one or more of the capillary tubes 308 into the downhole wellbore annulus, for example, to address a fluid leak or other unwanted fluid flow in the annulus. For example, the capillary tubes 308 can be connected to a fluid source and a fluid pump, where the fluid pump selectively pumps fluid from the fluid source through the capillary tubes 308 and into the wellbore.

Referring back to FIGS. 1 and 2, in some implementations, each capillary tube of the multiple capillary tubes 120 includes a fluid valve at a downhole longitudinal end of the respective capillary tube 120. The fluid valve selectively controls fluid flow through the respective capillary tube 120. For example, the fluid valve can control fluid egress out of the end of the respective capillary tube 120 and into the annulus 118, and restrict (partially or completely) ingress of fluid from the annulus 118 into the respective capillary tube 120. The fluid valve can take a variety of forms. In some instances, the fluid valve is a check valve, such as a one-way check valve, to selectively flow fluid from within the respective capillary tube 120 into the annulus 118. The one-way check valve can be an active valve or a passive valve, such as a flapper-type check valve, ball-type check valve, or other one-way check valve, to allow fluid flow in a first direction across the valve (for example, out of the capillary tube into the annulus 118) and restrict fluid flow in a second direction across the valve (for example, into the capillary tube from the annulus 118).

The capillary tubes 120 can be attached to the well tubing 116. For example, the example well system 100 of FIG. 1 includes multiple clamps 122 (nine shown) dispersed longitudinally along the tubing string 114 to attach the multiple capillary tubes 120 to the outer surface of the well tubing 116 of the tubing string 114. In certain instances, the well system 100 includes just one clamp 122 to attach one or more or all of the capillary tubes 120 to the outer surface of the well tubing 116 of the tubing string 114, or the well system 100 can include any number of clamps 122 to attach the capillary tubes 120 to the tubing string 114. The clamps 122 can be spaced along the longitudinal length of the tubing string 114, evenly or unevenly. In some examples, the clamps 122 are spaced along the tubing string 114 at a specified dimension, such as every 50 feet, every 100 feet, every 300 feet, every 1000 feet, or another dimension. The clamp(s) 122 maintain the position of the capillary tube(s) relative to the well tubing 116, and limit free movement of the capillary tube(s) 120 inside the annulus 118. The clamps 122 can take a variety of forms. For example, the clamps 122 can include a substantially cylindrical body positioned around both the well tubing 116 and one or more of the capillary tubes 120, where the cylindrical body can be tightened to secure the capillary tube or tubes 120 to the well tubing 116. In some examples, the clamps can include a hook-and-latch structure, where a hook or latch attached to a capillary tube 120 clamps with a corresponding latch or hook on the outer surface of the well tubing 116 of the tubing string 114. In some examples, the material of the clamps 122 is carbon steel or another metal, and is formed by casting, stamping, or another way.

In some implementations, each of the capillary tubes 120 can be at least partly coiled around the well tubing 116 at an uphole end of the respective capillary tubes 120, where a portion of the respective capillary tube 120 is wrapped around the tubing string 114, for example, to accommodate for expansion and compression of the tubing string 114 during operation. As shown in the example well system 100 of FIG. 1, the capillary tubes 120 are partially coiled around the outer surface of the well tubing 116 of the tubing string 114, for example, proximate to an uphole longitudinal end of the tubing string 114. In the example well system 100 of FIG. 1, a coiled portion 124 of the capillary tubes 120 is shown as wound around the well tubing 116 at the uphole end of the tubing string 114 proximate to (for example, adjacent to or within about 100 feet of) the wellhead 104. The coiled portion 124 of the capillary tubes 120 allows for some longitudinal movement of the capillary tubes 120 in the wellbore 102. For example, the coiled portion 124 of the capillary tubes 120 can partially uncoil or re-coil with expansion or compression of the tubing string 114. For example, as the well tubing 116 of the tubing string 114 expands, compresses, or otherwise moves substantially along longitudinal axis A-A (for example, in response to wellbore temperature changes, a moveable tool or sliding sleeve, tubing installation, or other cause of longitudinal movement), the capillary tubes 120 can move along with the well tubing 116 by a coiling or uncoiling of the coiled portion 124 of the capillary tubes 120. In some examples, the wrapping, or coiling, of the capillary tubes 120 provide the space out required during installation, such as production tubing installation, in addition to accommodating any expansion or compression of the well tubing 116 during installation or use.

The number of turns of the coiled portion 124 can vary. In some examples, the coiled portion 124 includes any number of turns between one and twenty turns, where each turn means one complete 360 degree wrap of a respective capillary tube 120 around the well tubing 116. In some examples, the coiled portion 124 can be positioned at about ⅓ of the total depth from the surface (instead of starting the coiling at the top of the tubing 116), and gradually coils starting at the ⅓ depth. In some instances, the multiple capillary tubes 120 wrap around the well tubing 116 together to form the coiled portion 124. In certain instances, the coiled portion 124 of the capillary tubes 120 can form a stacked structure, where a first capillary tube wraps around the well tubing 116, and a second capillary tube wraps around the well tubing 116 separate from the coiled portion of the first capillary tube.

In some implementations, one or more or all of the capillary tubes 120 exclude the coiled portion 124 proximate to the wellhead 104. In certain instances, the coiled portion 124 is located elsewhere along the tubing string 114, such as at a downhole location or an intermediate location between a downhole end and an uphole end of the tubing string 114. Alternatively or in addition, the capillary tubes 120 can be gradually wrapped around the well tubing 116 along part of or an entire length of the capillary tubes, or at respective downhole ends of the capillary tubes 120.

Figure 5:
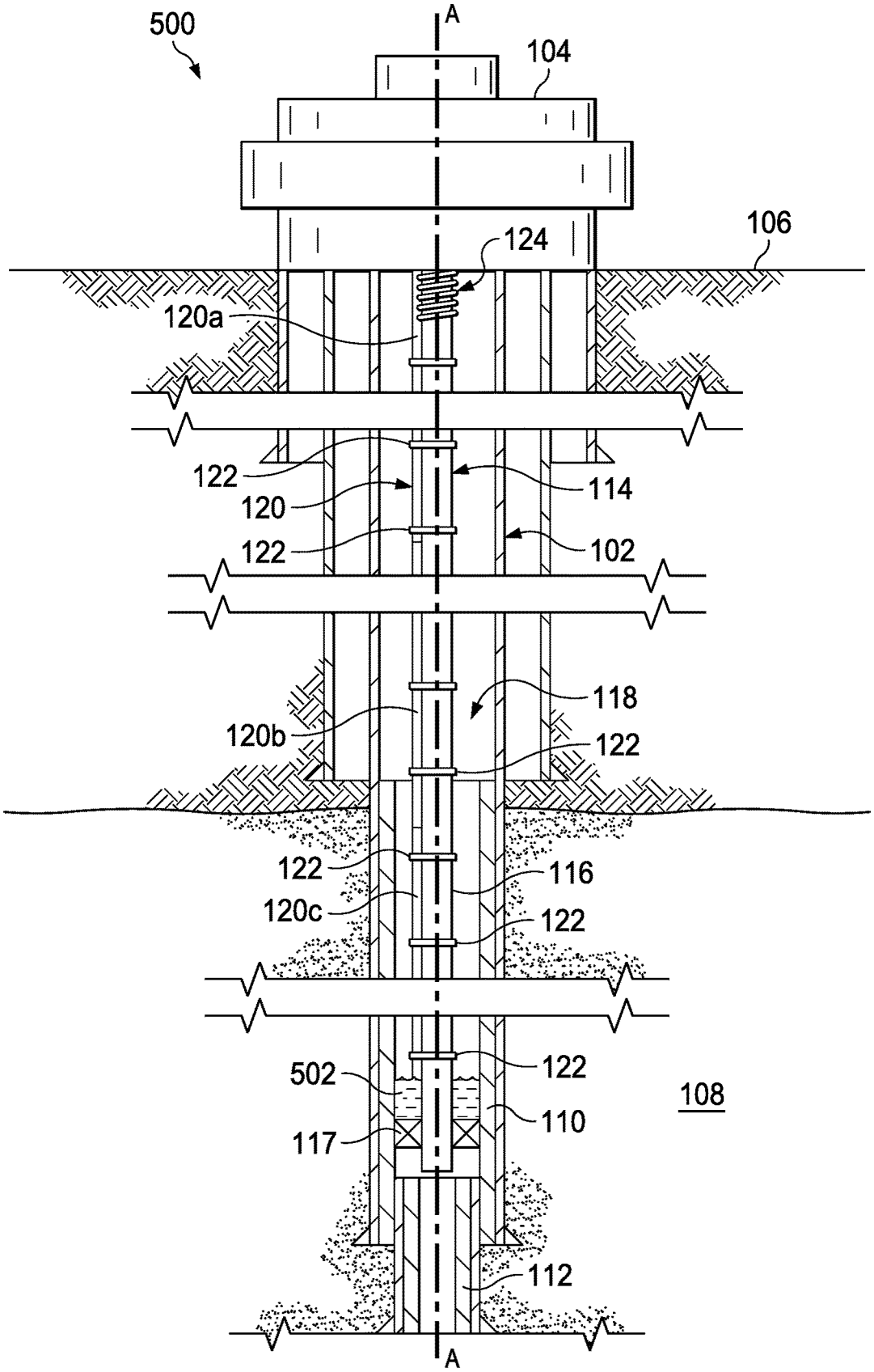
FIG. 5 is a schematic partial cross-sectional side view of an example well system.

In some implementations, the capillary tubes 120 are used to seal downhole leaks communicating to the annulus 118, such as a TCA. In instances of an unwanted fluid leak in the packer element 117, the capillary tubes 120 can be used to address and seal the leak in the packer element 117. For example, the annulus 118 is hydrostatically secured, and fluid in the annulus 118 is flushed. Then, using the closest capillary tube of the capillary tubes 120 to the packer element 117 (in the example well system 100 of FIG. 1, the closest capillary tube is the third capillary tube 120*c*), sealing fluid, such as cement, resin-based chemical, or another fluid is pumped through the third capillary tube 120*c* in a specified volume from the wellhead 104 to the longitudinal downhole end of the third capillary tube 120*c*. The specified volume of sealing fluid then exits the third capillary tube 120*c*, which then flows to the fluid leak in the packer element 117, thickening and hardening in time. FIG. 5 is a schematic partial cross-sectional side view of an example well system 500, similar to the well system 100 of FIG. 1, showing this thickened and hardened sealing fluid 502. The example well system 500 of FIG. 5 is exactly the same as the well system of FIG. 1, except the hardened sealing fluid 502 is shown as engaged with and sealing the packer element 117. Following the hardening of the sealing fluid 502 from the third capillary tube 120*c*, the capillary tube 120*c* (or another of the capillary tubes 120) can be used to test a pressure in the sealed zone, for example, to test the seal on the packer element 117 and ensure the seal is held. In instances of a fluid leak in the casing or wellbore wall, one or more of the capillary tubes 120 can be used to inject spacer (if needed) and a sealant.

Figure 6:
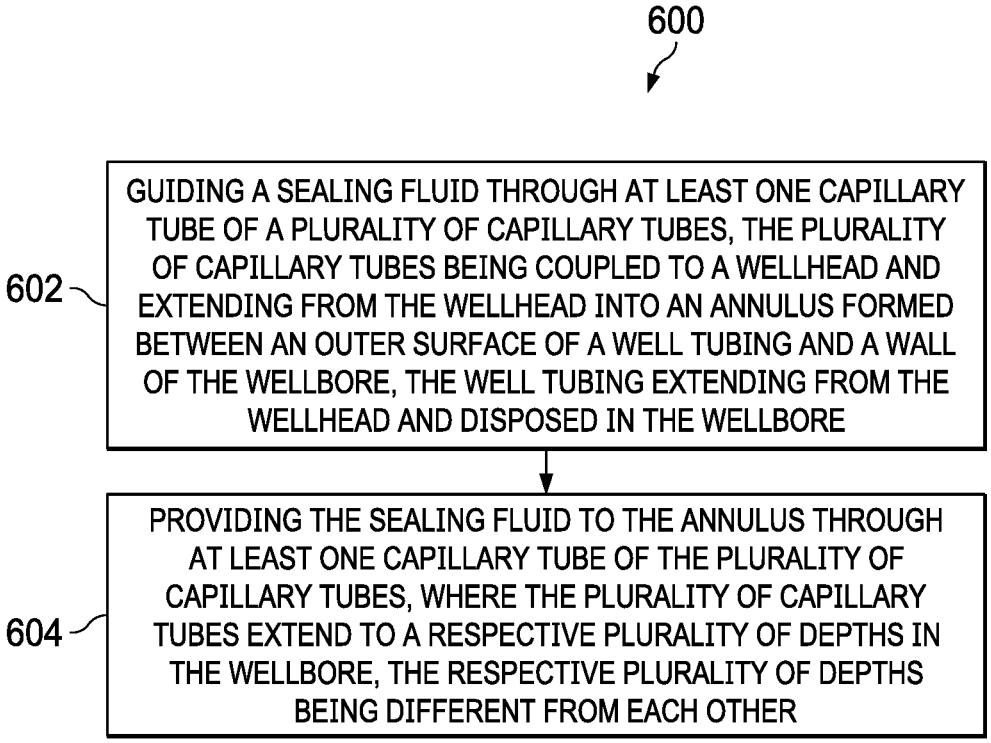
FIG. 6 is a flowchart describing an example method for providing a sealing fluid to an annulus of a wellbore.

FIG. 6 is a flowchart describing an example method 600 for providing a sealing fluid to an annulus of a wellbore, for example, performed by the example tubing string 114 of the example well system 100 of FIG. 1. At 602, a sealing fluid is guided through at least one capillary tube of a plurality of capillary tubes. The plurality of capillary tubes are coupled to a wellhead and extend from the wellhead into an annulus formed between an outer surface of a well tubing and a wall of the wellbore, and the well tubing extends from the wellhead and is disposed in the wellbore. At 604, the sealing fluid is provided to the annulus through at least one capillary tube of the plurality of capillary tubes. The plurality of capillary tubes extend to a respective plurality of depths in the wellbore, and the respective plurality of depths are different from each other. Providing the sealing fluid to the annulus can mean injecting or otherwise exiting the sealing fluid from the capillary tube(s). In some implementations, a portion of each of the plurality of capillary tubes are at least partially coiled around the outer surface of the well tubing, and the example method 600 includes partially uncoiling or partially recoiling the plurality of capillary tubes in response to an expansion or retraction of the well tubing. In certain implementations, the example method 600 includes selectively controlling flow of the sealing fluid through a respective fluid valve at a downhole longitudinal end of a respective capillary tube. Each fluid valve can be a one-way check valve, such that selectively controlling flow of the sealing fluid though the respective fluid valve includes selectively flowing the sealing fluid from within the respective capillary valve into the annulus. In some instances, the method 600 includes sealing a fluid leak or unwanted fluid flow in the annulus with the sealing fluid from the one or more capillary tubes.

A number of implementations have been described. Nevertheless, it will be understood that various modifications may be made without departing from the spirit and scope of the disclosure.

What is claimed is:

1. A well tubing system, comprising:

a well tubing extending from a wellhead and disposed in a wellbore; and a plurality of capillary tubes coupled to the wellhead and extending from the wellhead into an annulus formed between an outer surface of the well tubing and a wall of the wellbore along the well tubing and attached to the well tubing, the plurality of capillary tubes configured to provide a sealing fluid to the annulus, where the plurality of capillary tubes extend to a respective plurality of depths in the wellbore, the respective plurality of depths being different from each other, each capillary tube in the plurality of capillary tubes comprises a fluid valve at a downhole longitudinal end of the respective capillary tube, the fluid valve configured to selectively control fluid flow through the respective capillary tube.

2. The well tubing system of claim 1, wherein the plurality of capillary tubes extend longitudinally along the outer surface of the well tubing in contact with the outer surface of the well tubing and are attached to the well tubing by a plurality of clamps.

3. The well tubing system of claim 1, wherein the plurality of capillary tubes are dispersed radially about the well tubing.

4. The well tubing system of claim 1, wherein the longitudinal lengths of the plurality of capillary tubes are distributed evenly between a minimum threshold length and a maximum threshold length.

5. The well tubing system of claim 1, the plurality of capillary tubes comprising:

a first capillary tube extending a first longitudinal length along the well tubing, a second capillary tube extending a second longitudinal length along the well tubing greater than the first longitudinal length, and a third capillary tube extending a third longitudinal length along the well tubing greater than the second longitudinal length.

6. The well tubing system of claim 5, wherein the first longitudinal length of the first tubing, the second longitudinal length of the second tubing, and the third longitudinal length of the third tubing are evenly distributed between an uphole longitudinal end of the well tubing and a downhole longitudinal end of the well tubing.

7. The well tubing system of claim 6, wherein the third longitudinal length comprises an entire longitudinal length of the well tubing, the second longitudinal length comprises about two-thirds of the entire longitudinal length of the well tubing, and the first longitudinal length comprises about one-third of the entire longitudinal length of the well tubing.

8. The well tubing system of claim 1, wherein the fluid valve comprises a one-way check valve configured to selectively flow fluid from within the respective capillary valve into the annulus.

9. The well tubing system of claim 1, comprising a clamp to attach at least one of the capillary tubes of the plurality of capillary tubes to the outer surface of the well tubing.

10. The well tubing system of claim 1, wherein the wellbore is a cased wellbore, the wall of the wellbore comprises a casing, and the annulus is a tubing-casing annulus.

11. The well tubing system of claim 1, wherein the well tubing comprises a production tubing.

12. A well tubing system, comprising:

a well tubing extending from a wellhead and disposed in a wellbore; and a plurality of capillary tubes coupled to the wellhead and extending from the wellhead into an annulus formed between an outer surface of the well tubing and a wall of the wellbore, the plurality of capillary tubes configured to provide a sealing fluid to the annulus, where the plurality of capillary tubes extend to a respective plurality of depths in the wellbore, the respective plurality of depths being different from each other, wherein at least a portion of each of the plurality of capillary tubes is at least partially coiled around the outer surface of the well tubing.

13. The well tubing system of claim 12, wherein at least the portion of each of the plurality of capillary tubes is at least partially coiled around the outer surface of the well tubing at an uphole location proximate to the wellhead.

14. A well tubing system, comprising:

a well tubing extending from a wellhead and disposed in a wellbore;

a plurality of capillary tubes coupled to the wellhead and extending from the wellhead into an annulus formed between an outer surface of the well tubing and a wall of the wellbore, the plurality of capillary tubes configured to provide a sealing fluid to the annulus, where the plurality of capillary tubes extend to a respective plurality of depths in the wellbore, the respective plurality of depths being different from each other, and each capillary tube in the plurality of capillary tubes comprises a fluid valve at a downhole longitudinal end of the respective capillary tube, the fluid valve configured to selectively control fluid flow through the respective capillary tube; and a plurality of clamps positioned longitudinally along the well tubing to attach at least one capillary tube of the plurality of capillary tubes to the outer surface of the well tubing.

15. A method for providing a sealing fluid to an annulus of a wellbore, the method comprising:

guiding a sealing fluid through at least one capillary tube of a plurality of capillary tubes, the plurality of capillary tubes being coupled to a wellhead and extending from the wellhead into an annulus formed between an outer surface of a the well tubing and a wall of the wellbore along the well tubing and attached to the well tubing, the well tubing extending from the wellhead and disposed in the wellbore; and providing the sealing fluid to the annulus through at least one capillary tube of the plurality of capillary tubes, where the plurality of capillary tubes extend to a respective plurality of depths in the wellbore, the respective plurality of depths being different from each other, where each capillary tube of the plurality of capillary tubes comprises a fluid valve at a downhole longitudinal end of the respective capillary tube, and providing the sealing fluid to the annulus comprises selectively controlling flow of the sealing fluid through the respective fluid valve at the downhole longitudinal end of the respective capillary tube.

16. The method of claim 15, wherein at least a portion of each of the plurality of capillary tubes are at least partially coiled around the outer surface of the well tubing, the method comprising partially uncoiling or partially recoiling the plurality of capillary tubes in response to an expansion or retraction of the well tubing.

17. The method of claim 15, comprising attaching, with at least one clamping structure, the plurality of capillary tubes to the well tubing.

18. The method of claim 15, wherein the plurality of capillary tubes comprises a first capillary tube, a second capillary tube, and a third capillary tube, the first capillary tube extending a first longitudinal length along the well tubing, the second capillary tube extending a second longitudinal length along the well tubing greater than the first longitudinal length, and the third capillary tube extending a third longitudinal length along the well tubing greater than the second longitudinal length, and providing the sealing fluid to the annulus comprises providing the sealing fluid to the annulus at a first wellbore depth through the first capillary tube, providing the sealing fluid to the annulus at a second wellbore depth through the second capillary tube, or providing the sealing fluid to the annulus at a third wellbore depth through the third capillary tube.

19. The method of claim 15, wherein each fluid valve comprises a one-way check valve, and selectively controlling flow of the sealing fluid though the respective fluid valve comprises selectively flowing the sealing fluid from within the respective capillary valve into the annulus.

20. A well tubing system, comprising:

a production tubing extending from a wellhead and configured to be disposed in a wellbore; and a plurality of capillary tubes coupled to the wellhead and extending from the wellhead into an annulus formed radially outward of the production tubing, the plurality of capillary tubes extending longitudinally at least partially along an outer surface of the production tubing and attached to the production tubing, the plurality of capillary tubes configured to provide a sealing fluid to the annulus, each capillary tube in the plurality of capillary tubes comprises a fluid valve at a downhole longitudinal end of the respective capillary tube, the fluid valve configured to selectively control fluid flow through the respective capillary tube.

21. The well tubing system of claim 20, wherein the plurality of capillary tubes comprises a first capillary tube extending a first longitudinal length along the production tubing, a second capillary tube extending a second longitudinal length along the production tubing greater than the first longitudinal length, and a third capillary tube extending a third longitudinal length along the production tubing greater than the second longitudinal length.

* * * * *